US005551730A

United States Patent [19]

Barreca et al.

[11] Patent Number: 5,551,730

[45] **Date of Patent: * Sep. 3, 1996**

[54] GREETING CARDS

[76] Inventors: Robert Barreca, 306 Lamarck Dr., Snyder, N.Y. 14226; Karen Hurley, 117 Chatham, Buffalo, N.Y. 14216

[ * ] Notice: The term of this patent shall not extend beyond the expiration date of Pat. No. 5,303,957.

[21] Appl. No.: 470,978

[22] Filed: Jun. 6, 1995

Related U.S. Application Data

[60] Continuation of Ser. No. 185,501, Jan. 24, 1994, Pat. No. 5,435,603, which is a division of Ser. No. 849,951, Mar. 12, 1992, Pat. No. 5,303,957.

[51] Int. Cl.[6] ..... B42D 15/04

[52] U.S. Cl. ..... 283/117; 40/124.1

[58] Field of Search ..... 40/124.1; 283/117; 446/147; 434/368; 428/38

[56] References Cited

U.S. PATENT DOCUMENTS

| | | | |
|---|---|---|---|
| 1,002,993 | 9/1911 | Huserich | 428/38 X |
| 1,146,855 | 7/1915 | Emerson | 428/38 X |
| 1,879,695 | 9/1932 | Leissner | 428/38 X |
| 2,190,627 | 2/1940 | Payberg | 428/38 X |
| 3,268,379 | 8/1966 | Baker | 428/38 X |
| 3,815,263 | 6/1974 | Oberwager | 428/38 X |
| 4,055,011 | 10/1977 | Longnecker | 40/124.1 |
| 4,430,548 | 2/1984 | Macken | 219/121 |
| 4,458,133 | 7/1984 | Macken | 219/121 |
| 5,117,569 | 6/1992 | Bean | 40/124.1 |
| 5,303,957 | 4/1994 | Barreca et al. | 283/117 |
| 5,318,327 | 6/1994 | Daneshvar | 283/117 |

FOREIGN PATENT DOCUMENTS

| | | | |
|---|---|---|---|
| 3530227 | 2/1987 | Germany | 283/117 |
| 227296 | 9/1990 | Japan | 283/117 |
| 927561 | 5/1963 | United Kingdom . | |
| 2179595 | 3/1987 | United Kingdom | 283/117 |

*Primary Examiner*—Peter Vo

*Attorney, Agent, or Firm*—Hodgson, Russ, Andrews, Woods & Goodyear, LLP

[57] ABSTRACT

An aesthetically pleasing greeting card having a stained-glass window effect provided by a pattern of cut-outs in a face panel thereof and a panel of translucent material having a corresponding colored pattern rearwardly thereof, the colored pattern allowing the transmission of light therethrough to provide a stained-glass effect. The card may be attached to a window or other light source to enhance the aesthetically pleasing stained-glass window effect.

18 Claims, 2 Drawing Sheets

GREETING CARDS

This is a continuation of application Ser. No. 08/185,501 filed Jan. 24, 1994 now U.S. Pat. No. 5,435,603, which is a divisional of application Ser. No. 07/849,951 filed Mar. 12, 1992 now U.S. Pat. No. 5,303,957.

The present invention relates generally to greeting cards.

Greeting cards are typically provided with decorative artistic work and messages relating to the purpose of the greeting.

Art providing a general background to the present invention includes U.S. Pat. Nos. 1,002,993; 1,146,855; 1,879,695; 2,190,627; 3,268,379; 3,815,263; 4,430,548; and 4,458,133.

It is an object of the present invention to provide an artistically pleasing decorative structure for a greeting card.

In order to achieve such an artistically pleasing greeting card, in accordance with the present invention a pattern of cut-outs is provided in a face panel composed of opaque material, and a panel of translucent material is provided rearwardly of the face panel and has at least one light transmittable region aligned with the pattern of cut-outs to provide a stained-glass effect similar to the stained-glass window effect in churches. This effect may be particularly pleasing when, for example, the cards are applied to a window to receive sunlight therethrough.

U.S. Pat. No. 2,190,627 to Payberg discloses an ornamental device in the form of a paper transparency for simulating a stained-glass window. The device comprises two face members of cardboard or the like provided with cut-out portions bounded by rib portions to form the outline of a design, and a color-carrying member of translucent paper is provided with regions of different and contrasting colors. The device is disclosed for use typically in a door or window or in front of a light source so that light traveling through the transparent portion is colored to produce a pleasing effect. However, Payberg fails to teach or suggest the provision of its paper transparency as part of a greeting card construction.

The above and other objects, features, and advantages of the present invention will be apparent in the following detailed description of the preferred embodiments thereof when taken in conjunction with the accompanying drawings in which like reference numerals denote like or similar parts throughout the several views.

DETAILED DESCRIPTION OF THE PREFERRED EMBODIMENTS

Figure 1:
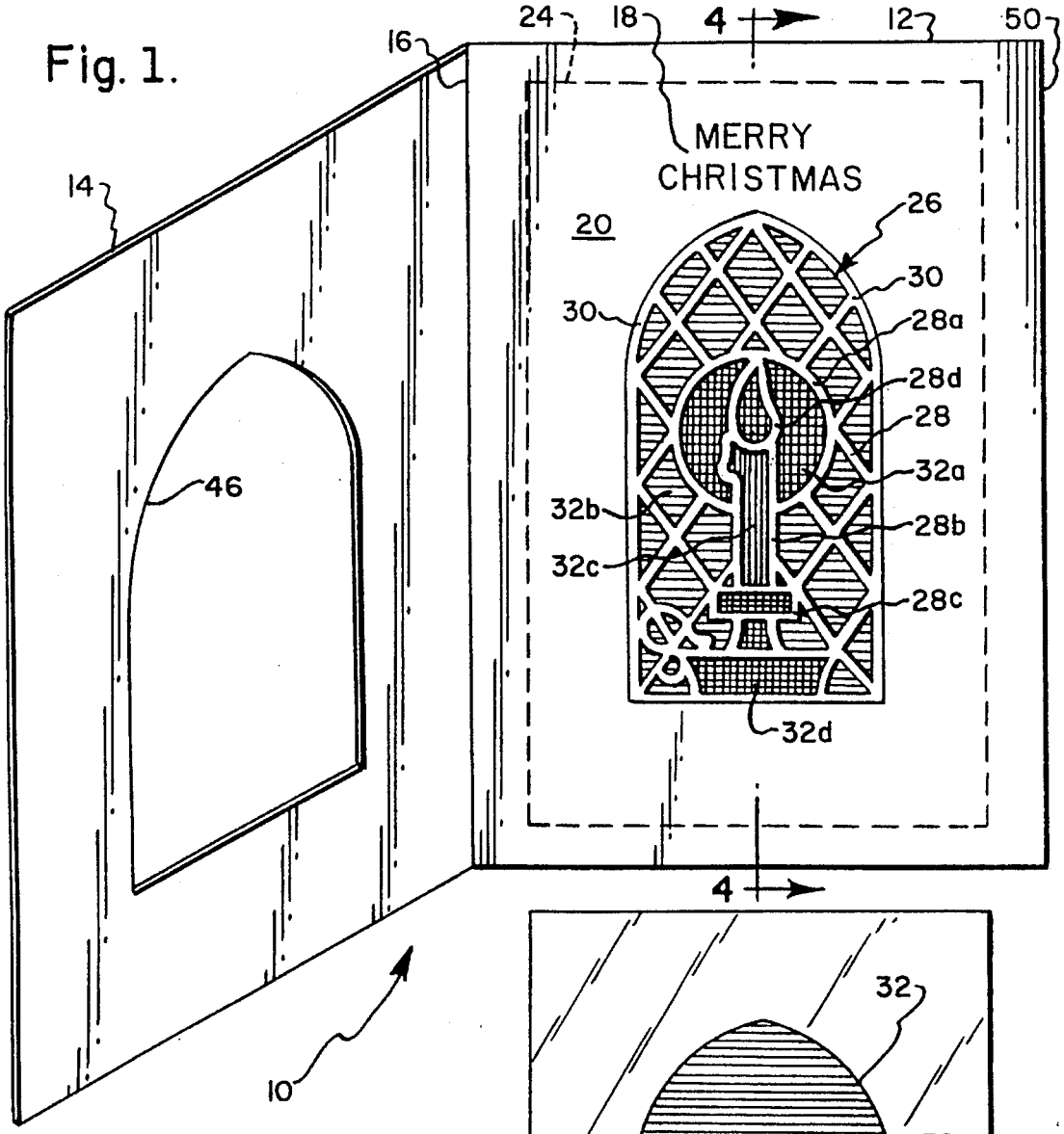
FIG. 1 is a perspective view of a greeting card which embodies the present invention.

Referring to FIG. 1, there is illustrated generally at 10 a greeting card which may be used to convey a message of greeting in connection with a holiday such as Christmas, a birthday, or any other occasion, whether special or not, wherein a person desires to convey a message of greeting or the like to another person. Thus, as the term is used herein and in the claims, a greeting card is meant to refer to a card having a decorative or artistic appearance and which includes thereon or therewith a writing, which may be an inscription, in the form of a greeting.

The card 10 includes a first portion 12 and a second portion 14 which is integrally connected thereto and which folds along fold line 16 to lie flat against the first portion 12 in which case the card is in a closed condition or to be opened up, as shown in FIG. 1. A message, illustrated at 18, in the form of a greeting is inscribed or otherwise provided in the card portion 12. A message may additionally or alternatively be provided otherwise on the card 10 such as on the face (not shown) of the second portion 14, the message or messages not being limited to any particular location or locations on the card. In accordance with the present invention, a greeting card may come in various sizes and shapes. For example, the card may not contain a second portion or, on the other hand, it may contain more than two portions.

Figure 4:
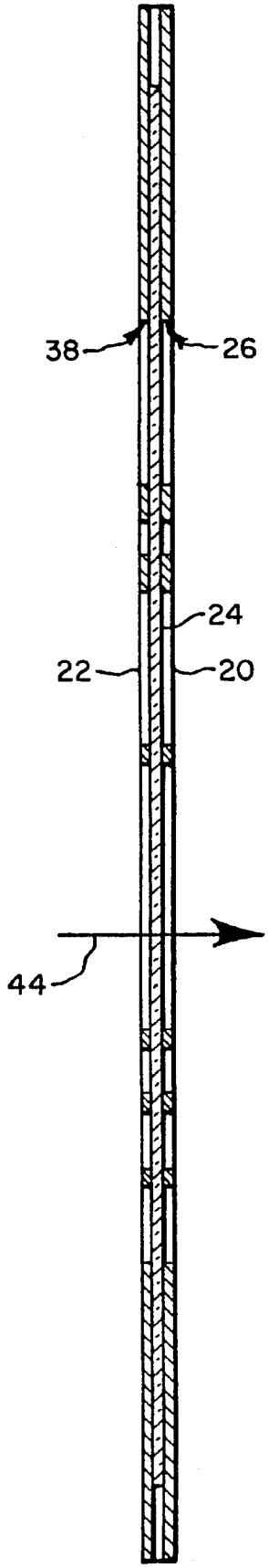
FIG. 4 is a sectional view of the greeting card of FIG. 1 taken along lines 4—4 thereof.

Referring to FIG. 4, the card portion 12 includes a face panel 20, for viewing by a person and which may contain the message 18, and a rear panel 22. Between the panels 20 and 22 is disposed a panel 24 of translucent material. The rear panel 22 may be integrally connected to the face panel 20 and folded about fold line 50 to overlie the face panel 20 and adhesively or otherwise suitably secured thereto so as to protectively maintain the translucent panel 24 therebetween. However, it should be understood that, if desired, such a rear panel need not be provided at all or, if provided, may be provided as a separate panel adhesively or otherwise attached to panel 20.

The face panel 20 includes a pattern of cut-outs, illustrated at 26, including ribs or lead lines 28 in a decorative pattern and may include a border region 30. The ribs 28 and border 30 may, for example, be colored black.

Figure 2:
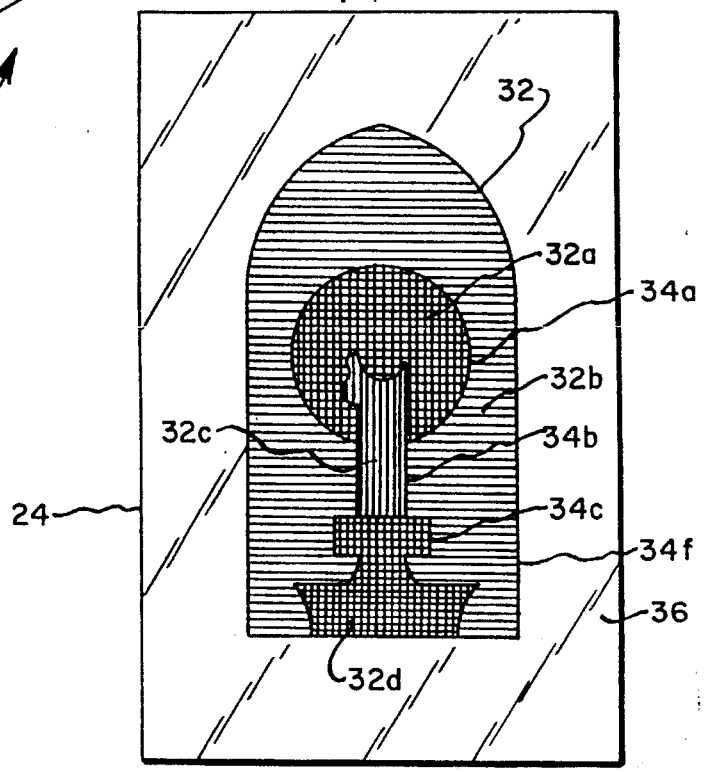
FIG. 2 is a face view of a panel of translucent material for the greeting card of FIG. 1.

The translucent material 24 includes a region 32 having differently colored portions corresponding to the pattern of cut-outs 26 in the face panel 20. Thus, the different colored regions meet at boundary lines 34 which, with the translucent material 24 suitably aligned with the pattern 26 of cut-outs, are hidden by ribs 28 in the face panel 20. For example, boundary line 34*a* is covered by and lies hidden under rib 28*a*. Boundary line 34*a* separates a region 32*a* which may be colored yellow from a region 32*b* which may be colored blue. Boundary line 34*b* separates a region 32*c*, which may be colored red, from the region 32*b*, and boundary line 34*c* separates a region 32*d*, which may be colored yellow, from the region 32*b*. Boundary line 34*b* is covered by rib 28*b*. Boundary line 34*c* is covered by rib 28*c*. Thus, the ribs 28 may be said to act as molding over the intersections between contrasting colors in the translucent material 24. It should be noted that ribs 28 may be provided to achieve other decorative effects than to act as molding. Thus, rib 28*d* does not cover a boundary line but is instead provided to achieve the effect of a candle flame, the portions of region 32*a* both inside and outside the rib 28*d* being of the same color, yellow, as shown in FIG. 2. The boundary line 34*f* between the colored regions and the non-colored region 36 is hidden by the border region 30, the non-colored region 36 being hidden behind the opaque material of the face panel 20 outside of the pattern 26 of cut-outs. Thus, an artistically pleasing appearance of, for example, a flickering candle against a blue background is provided.

Figure 3:
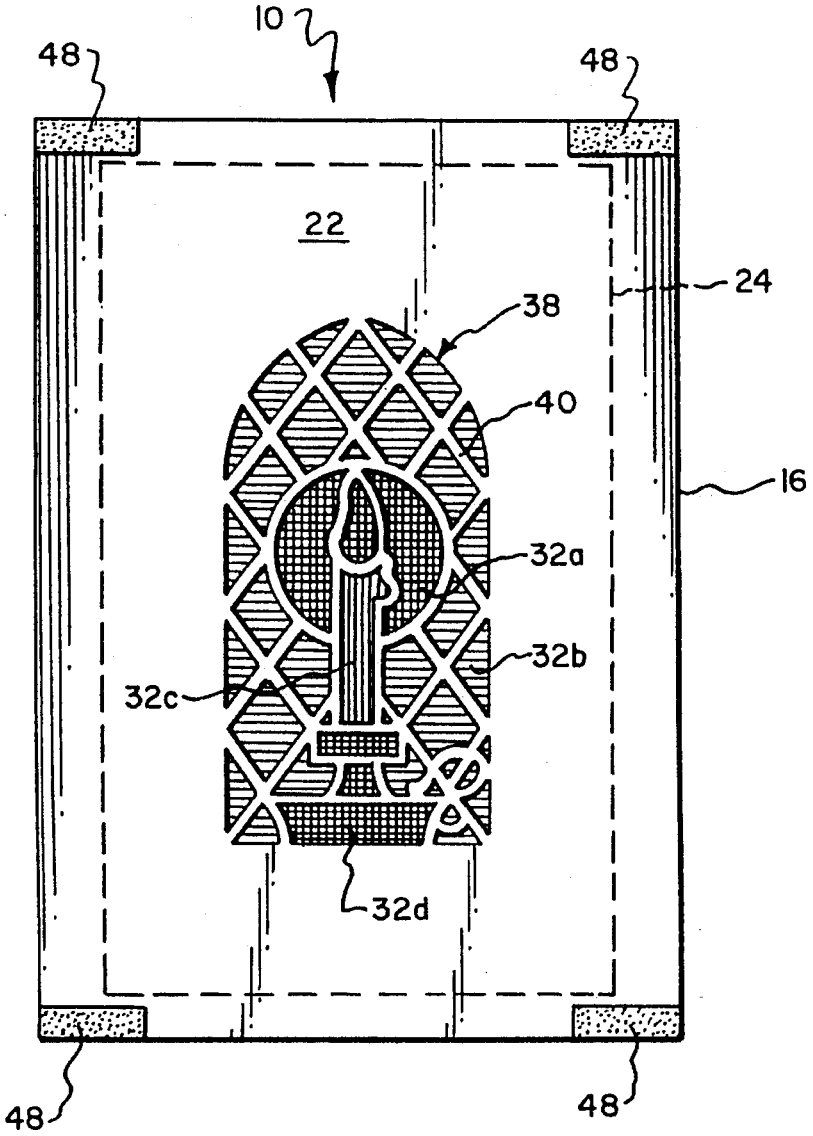
FIG. 3 is a rear view of the greeting card of FIG. 1.

Referring to FIG. 3, the rear panel 22 may have a pattern of cut-outs 38 which may correspond to the pattern 26 of cut-outs in the face panel 20 and be aligned therewith so as to similarly cover the boundary lines 34 and not obstruct the passage of light through the regions 32 between the ribs 28. The pattern of cut-outs 38 including the internal ribs 40 thereof acts to protect the translucent material panel 24. However, if the rear panel 22 is not meant for viewing by a person, it is not essential to the present invention that the internal ribs 40 be provided. The face and rear panels 20 and 22 respectively may be inexpensively die-cut to form the respective cut-out patterns 26 and 38.

The panel 24 is composed of a suitable translucent material, preferably an uncolored vellum material, to which colors are added to provide the colored regions 32. Acetate is an example of another material which may be used. In order to achieve a brilliant color effect inexpensively, the color regions are preferably printed on the vellum material in solid colors. However, other suitable techniques may be used. For example, the colors may be printed in a dot pattern, or the technique of silk screening may be used. These techniques are commonly known in the art to which this invention pertains. Thus, light may shine through the cut-outs 26 and 38, as illustrated at 44 in FIG. 4, to provide the stained-glass window appearance.

If desired, a cut-out 46 corresponding to the border region 30 may be provided in the second card portion 14 to allow viewing of the resulting image on the first portion 12 without opening up the card. The card may as a result be strategically folded to highlight the stained-glass-like pattern.

Unlike conventional greeting cards, a card according to the present invention may desirably be displayed on a window to enhance the aesthetically pleasing stained-glass motif. The ribs 28 and border 30 represent the lead lines found in stained-glass art. Thus, adhesive strips, illustrated at 48 in FIG. 3, or other suitable means of attachment are provided on the rear panel 22 for easily mounting thereof to a window or other light source to allow sunlight or other light to shine through the colored regions 32 to enhance the stained-glass window effect.

A greeting card may be made in accordance with the present invention by die-cutting a piece of opaque cardboard material to provide the desired lead lines in the face and rear panels. The material is provided with fold lines 16 and 50 to define the face and rear panels 20 and 22 respectively and the second portion 14. A piece of vellum material or other suitable translucent material is then provided with the desired colored patterns, and the translucent panel 24 thus colored is inserted between the face and rear panels in suitable alignment with the patterns 26 and 38 of cut-outs and adhesively or otherwise suitably attached to preferably the face panel 20, and the rear panel 22 is then adhesively or otherwise suitably attached to the face panel 20. Suitable adhesive strips 48 may then be applied to the rear panel 22 for the purposes of mounting the card to a window or other light source.

It should be understood that while the invention has been described in detail herein, the invention can be embodied otherwise without departing from the principles thereof, and such other embodiments are meant to come within the scope of the present invention as defined by the appended claims.

What is claimed is:

1. A greeting card comprising panel means and further comprising inscription means on said panel means for providing a greeting, said panel means comprising a face panel composed of opaque material and including means having a plurality of ribs defining a decorative pattern of cut-outs therein, and a panel of translucent material rearwardly of said face panel and having a plurality of light transmittable colored regions of different colors with boundary lines defined therebetween, the boundary lines being aligned with said ribs to provide a stained-glass effect, said panel means further comprising a protective back panel, said panel of translucent material being between said face panel and said back panel, and said back panel including cut-out means to allow unobstructed passage of light through said translucent material.

2. A greeting card according to claim 1 wherein said face panel is die-cut to form said pattern.

3. A greeting card according to claim 1 wherein the colors for said colored regions are printed on said translucent material in solid colors to achieve a brilliant color illumination as light is transmitted through the colored regions.

4. A greeting card according to claim 1 wherein said translucent material is composed of vellum.

5. A greeting card according to claim 1 wherein said pattern of cut-outs has black borders.

6. A greeting card according to claim 1 further comprising a cover panel foldably integrally connected to said face panel to overlie said face panel and including cut-out means to allow viewing of the stained-glass effect and unobstructed passage of light through said translucent material with said cover panel overlying said face panel.

7. A greeting card according to claim 1 further comprising means for attaching the card to a window.

8. A greeting card comprising panel means and further comprising inscription means on said panel means for providing a greeting, said panel means comprising a face panel composed of opaque material and including means having a plurality of ribs defining a decorative pattern of cut-outs therein, and a panel of translucent material rearwardly of said face panel and having a plurality of light transmittable colored regions of different colors with boundary lines defined therebetween, the boundary lines being aligned with said ribs to provide a stained-glass effect, said panel means further comprising a cover panel foldably integrally connected to said face panel to overlie said face panel, and wherein said cover panel includes cut-out means to allow viewing of the stained-glass effect.

9. A greeting card according to claim 8 wherein said face panel is die-cut to form said pattern.

10. A greeting card according to claim 8 wherein said translucent material is composed of vellum.

11. A greeting card according to claim 8 further comprising means for attaching the card to a window.

12. A greeting card comprising panel means and further comprising inscription means on said panel means for providing a greeting, said panel means comprising a face panel composed of opaque material, means defining a front surface to be viewed on said face panel, a rear surface on said face panel, means including a plurality of ribs defining a decorative cut-out pattern in said face panel, and a panel of translucent material disposed rearwardly of said face panel and alongside said rear surface, said translucent material panel having a plurality of light transmittable colored regions of different colors with boundary lines defined therebetween, the boundary lines being aligned with said ribs whereby said colored region is rearwardly of said cut-out pattern to provide a stained glass effect during viewing of said front surface.

13. A greeting card according to claim 12 wherein said panel means further comprises a protective back panel, said panel of translucent material being between said face panel and said back panel, and said back panel including cut-out means to allow unobstructed passage of light through said translucent material.

14. A greeting card according to claim 12 wherein said panel means further comprises a cover panel foldably integrally connected to said face panel to overlie said front surface and including cut-out means to allow viewing of the stained-glass effect and unobstructed passage of light through said translucent material with said cover panel overlying said front surface.

15. A greeting card according to claim 14 wherein said panel means further comprises a protective back panel, said panel of translucent material being between said face panel and said back panel, and said back panel including cut-out means to allow unobstructed passage of light through said translucent material.

16. A greeting card according to claim 12 further comprising means for attaching the card to a window.

17. A greeting card according to claim 12 wherein the colors for said colored regions are printed on said translucent material in solid colors to achieve a brilliant color illumination as light is transmitted through the colored regions.

18. A greeting card according to claim 12 wherein said message means is on said front surface of said face panel.

* * * * *